US005884512A

United States Patent [19]

Wayne

[11] Patent Number: 5,884,512

[45] Date of Patent: Mar. 23, 1999

[54] MULTI-USE LOCK HOUSING AND CYLINDER

[76] Inventor: Kenneth Wayne, 5205 Behrwald Ave., Cleveland, Ohio 44144

[21] Appl. No.: 984,877

[22] Filed: Dec. 4, 1997

[51] Int. Cl.[6] ..... E05B 9/06

[52] U.S. Cl. ..... 70/370; 70/373; 70/374; 70/379 R; 70/417; 70/449; 70/451; 70/461

[58] Field of Search ..... 70/451, 370, 379 R, 70/379 A, 380, 417, 373, 374, 447–449, 461, 371, 372, 367–369

[56] References Cited

U.S. PATENT DOCUMENTS

| | | | |
|---|---|---|---|
| 904,580 | 11/1908 | Voight | 70/374 |
| 1,027,777 | 5/1912 | Shaw | 70/374 |
| 1,100,245 | 6/1914 | Kimball | 70/374 |
| 1,422,595 | 7/1922 | Maxwell | 70/373 |
| 1,564,463 | 12/1925 | Best | 70/380 |
| 2,014,233 | 9/1935 | Keil | 70/379 R |
| 2,347,802 | 5/1944 | Voight | 70/380 |
| 2,381,136 | 8/1945 | Oxhandler | 70/374 |
| 2,802,685 | 8/1957 | Duvall | 70/416 |
| 2,837,908 | 6/1958 | Segal . | |
| 2,877,638 | 3/1959 | Muttart . | |
| 2,948,140 | 8/1960 | Etsten | 70/379 R |
| 3,934,437 | 1/1976 | Crepinsek | 70/451 X |
| 4,338,806 | 7/1982 | Cox | 70/373 X |
| 4,672,828 | 6/1987 | Theriault | 70/373 |
| 4,793,166 | 12/1988 | Marks | 70/379 R |
| 5,161,397 | 11/1992 | Raybary | 70/374 |
| 5,233,851 | 8/1993 | Florian | 70/367 |

*Primary Examiner*—Lloyd A. Gall
*Attorney, Agent, or Firm*—Rankin, Hill, Porter & Clark LLP

[57] ABSTRACT

A multi-use lock housing and cylinder includes a cylinder of a size and shape such as that typically used in key-in-knob locks. A two-part housing includes an outer housing portion and an inner housing portion, each having a bore and a slot into which the lock cylinder can be fitted. The housing and its associated lock cylinder can be used as a direct replacement for existing rim lock cylinders or mortise lock cylinders. The upper, front portion of the outer housing portion can be enlarged for added strength. The enlarged portion can be provided with a receptacle into which a piece of hardened metal is fitted. An extension having a pair of right-angled slots projects from the rear face of the cylinder and the inner housing. The slots receive driving members in the form of cams or tailpieces such as those commonly used with rim cylinders and mortise cylinders. Additional inner housings of different lengths can be provided for those applications that require mortise cylinders of different lengths. The invention enables virtually any existing rim cylinder or mortise cylinder to be replaced without any factory components, thereby greatly reducing a locksmith's inventory requirements.

20 Claims, 6 Drawing Sheets

MULTI-USE LOCK HOUSING AND CYLINDER

BACKGROUND OF THE INVENTION

1. Field of the Invention

The invention relates to lock mechanisms and, more particularly, to a lock housing and cylinder that can be used with a wide variety of pin tumbler locks.

2. Description of the Prior Art

Doors for homes and commercial establishments are protected predominantly by key-actuated pin tumbler locks. In the description that follows, the word "lock" or "locks" will refer to pin tumbler locks, as opposed to other types of locks such as lever tumbler locks, disc tumbler locks, or warded locks.

In a typical lock, a cylinder body or case houses a cylindrical, rotatable plug having a longitudinally extending keyway. A driving member such as a cam or tailpiece usually is connected to the rear face of the plug. The driving member actuates a bolt-throwing or latch-moving mechanism.

The interface between the plug and the case is called the shear line. A plurality of radially extending, parallel chambers are formed in the case and the plug. Two different-length, spring-biased pins (upper, or driver pins and lower pins) are disposed in each chamber. Under normal conditions, the drivers block the shear line, thereby preventing the plug from being rotated relative to the case. However, when a properly configured key is inserted into the keyway, the drivers and lower pins are moved so that the top of the lower pins and the bottom of the drivers meet at the shear line. The plug then can be rotated to cause rotation of the driving member and subsequent retraction or extension of the bolt or latch.

The foregoing construction makes up the vast majority of key-actuated pin tumbler locks. Such locks are used in a wide variety of door applications such as key-in-knob locks, mortise locks, and rim locks. Key-in-knob locks are used as the primary lock for many residential doors, while mortise locks are used for many residential and commercial doors, including aluminum-framed glass doors. Rim locks are used as a secondary lock for residential and commercial doors, usually in the form of tubular or vertical dead bolts.

Locksmiths frequently must rekey or replace residential or commercial locks on short notice, often during non-business hours. Often the locksmith does not know what brand of lock or even the type of lock that must be rekeyed or replaced until arriving at the work site. In order to accommodate the possibility of having to rekey or replace a wide variety of locks, the locksmith must carry a large selection of locks and lock parts at all times. Carrying a large inventory of seldom-used locks and lock parts is both inconvenient and expensive. This is a significant problem when one considers the numerous brands of locks that exist, some of which no longer are in production.

Another problem with existing locks is the relative weakness of the locks. That is, it is possible with certain locks for an instrument such as a punch to be driven through the front wall of the lock, thereby destroying the pins and permitting the lock to be opened without a proper key. It also is possible for the pins to be drilled out through the front of the lock.

Prior art locks have not adequately addressed the foregoing problems. For example, the patent to Marks, U.S. Pat. No. 4,793,166, discloses a multi-use lock cylinder that can be used with either a tubular deadbolt lock or a key-in-knob lock by using tailpieces of different configurations. However, there is suggestion that the lock cylinder of the '166 patent could be used in a rim cylinder or a mortise cylinder.

The patent to Oxhandler, U.S. Pat. No. 2,381,136, discloses an adjustable cylinder lock mechanism in which the length of a cylinder housing can be adjusted, and different driving members can be attached to the rear of a rotatable plug. The '136 patent discloses a front housing section that contains a conventional pin tumbler mechanism. A threaded rear section can be connected to the housing section for mortise lock applications, or it can be removed for rim lock applications. The '136 patent requires that the threaded rear section be discarded for rim lock applications. It also permits cams or tailpieces to be attached to the plug in only one orientation. The '136 patent does not address the subject of rekeying or replacing key-in-knob lock cylinders.

The patent to Maxwell, U.S. Pat. No. 1,422,595, discloses a cylinder lock in which an armor cap is fitted to the front of the cylinder. Unfortunately, such a cap is excessively bulky and unduly lengthens the lock. It also requires that the sides of the cylinder be modified to accommodate cap-retaining ears that project from the sides of the cap.

Other patents that show adjustable or adaptable locks include U.S. Pat. No. 904,580, U.S. Pat. No. 1,027,777, U.S. Pat. No. 1,564,463, U.S. Pat. No. 2,802,685, U.S. Pat. No. 2,837,908, U.S. Pat. No. 2,877,638, U.S. Pat. No. 4,672,828, U.S. Pat. No. 5,161,397, and U.S. Pat. No. 5,233,851. None of these patents addresses the problem of providing a lock cylinder and housing that will work effectively with key-in-knob locks, rim locks, and mortise locks, and which will do so with enhanced security for the pins of the cylinder.

Desirably, a lock cylinder and housing would be available that would enable a locksmith to rekey or replace almost any existing lock without the need to carry factory replacement parts or locks for the brand and type of lock in question. Any such components hopefully would be inexpensive, easy to install, and few in number. Additionally, such components desirably would be effective in resisting punching or drilling of the pins of the cylinder.

SUMMARY OF THE INVENTION

In response to the foregoing concerns, the present invention provides a new and improved multi-use lock housing and cylinder that enables virtually any existing lock to be rekeyed or replaced without the need for factory components. The invention includes a cylinder of a size and shape such as that typically used in key-in-knob locks. That is, the cylinder has a small case from which a pin-containing "bible" projects along its length. The case contains a cylindrical opening in which a rotatable plug is disposed. The plug includes a keyway into which a properly configured key can be fitted. The lock cylinder as described can be used as a direct replacement for existing lock cylinders in most key-in-knob locks. Because there are approximately 25 types of key blanks in common use, a locksmith need only carry 25 different lock cylinders to accommodate most situations that may be encountered concerning key-in-knob locks.

The invention also includes a housing into which the lock cylinder can be fitted. Due to its size, shape, and construction, the housing and its associated lock cylinder can be used as a direct replacement for existing rim lock cylinders or mortise lock cylinders. The housing according to the invention is in two parts —an outer housing and an inner housing. The outer housing has a smooth-walled cylindrical body portion that includes a bore that receives the front portion of the lock cylinder. The upper portion of the outer housing includes a slot into which the front portion of the bible is fitted. The outer housing has a front face about which a circumferential rim extends.

In the preferred embodiment, a pair of threaded openings are formed in the rear face of the outer housing on either side of the bore. Also, the upper portion of the front face is enlarged for added strength. If desired, the enlarged section of the front face can be provided with a slot into which a piece of hardened metal is fitted.

The inner housing has an exteriorly threaded cylindrical body portion that includes a second bore that receives the rear portion of the lock cylinder. The upper portion of the inner housing includes a slot into which the rear portion of the bible is fitted. The sides of the body portion include longitudinally extending grooves into which conventional mortise cylinder-retaining set screws can be received.

In the preferred embodiment, the body portion has a pair of longitudinally extending threaded openings disposed on either side of the second bore that are aligned with the threaded openings in the outer housing. The housings can be held together by small case-hardened screws whose heads are disposed entirely within the threaded openings in the inner housing. After the housings have been joined in this manner, the threaded openings can be used to receive the screws commonly used to hold rim cylinders in place.

An extension projects from the rear face of the plug, which extension has a pair of right-angled slots formed therein. The extension projects through the rear face of the inner housing. A circumferential groove encircles the extension and intersects the slots. The slots receive driving members in the form of cams or tailpieces such as those commonly used with rim cylinders and mortise cylinders. The cams or tailpieces can be oriented vertically or horizontally as may be necessary. A retaining ring can be fitted into the groove to hold the cam or tailpiece in place within its selected slot. In the preferred embodiment, the retaining ring includes a radially inwardly extending projecting portion that engages the other slot to prevent rotation of the retaining ring.

If desired, additional inner housings, longer than the above-described inner housing, can be provided. Such longer inner housings can be used for those applications that require mortise cylinders of different lengths. In such cases, the invention includes a cylindrical adapter, or cam driver, having a spline on one face. The spline engages a selected slot of the plug extension in driving relationship. A suitably configured cam can be connected to the cam driver by screws.

By using the housing according to the invention, virtually any existing rim cylinder or mortise cylinder can be replaced. No factory components of any type are required. Cams or tailpieces from existing locks can be re-used in some instances. Because only about 25 lock cylinders are required to accommodate most possibilities, 25 lock cylinders and one complete housing assembly will enable any one of 75 lock cylinders to be replaced, that is, 25 key-in-knob cylinders, 25 rim cylinders, and 25 mortise cylinders. This represents a significant reduction of inventory normally carried by a locksmith. In addition, a rim cylinder or mortise cylinder according to the invention is stronger than conventional rim cylinders or mortise cylinders due to the strengthened outer housing of the invention.

The foregoing and other features and advantages of the invention will be discussed in more detail in the description and claims that follow.

DESCRIPTION OF THE PREFERRED EMBODIMENT

Figure 1:
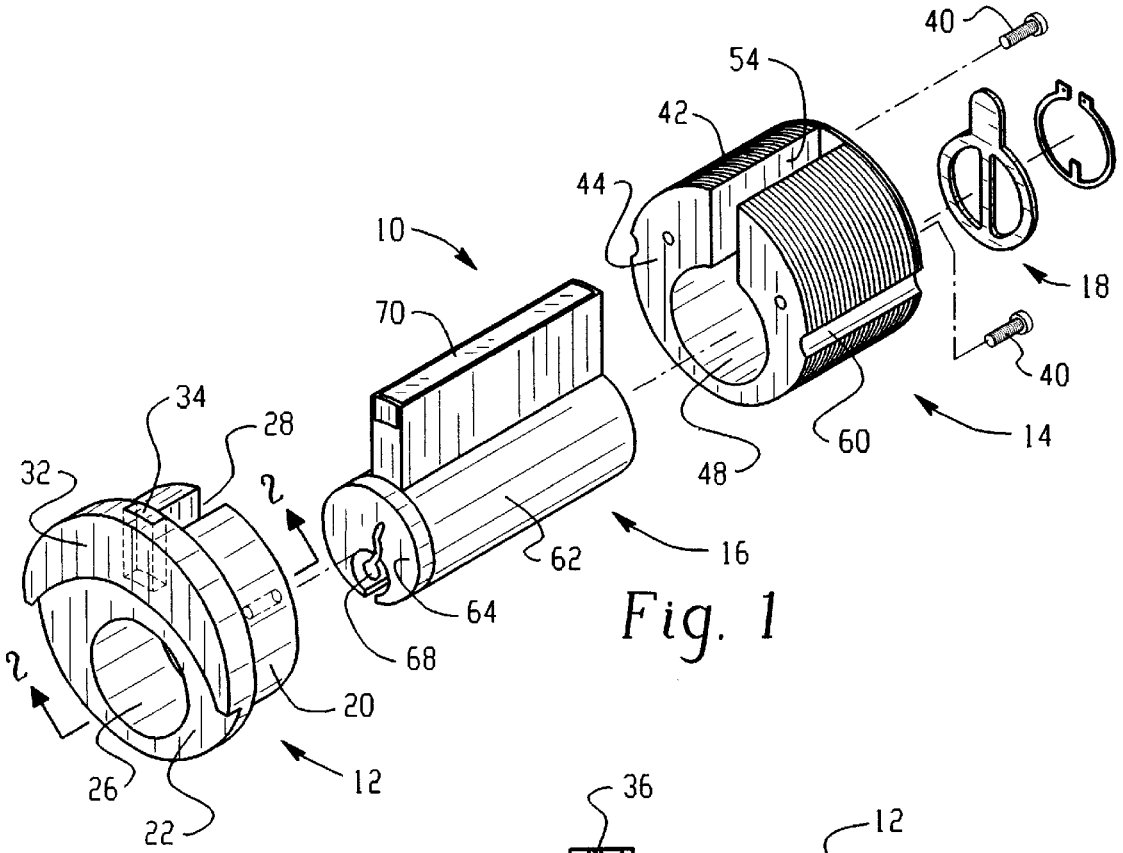
FIG. 1 is an exploded, perspective view of a multi-use lock housing and cylinder according to the invention in a mortise lock configuration.

Referring to the various figures, apparatus according to the invention is indicated generally by the reference numeral 10. The apparatus 10 includes a multi-use lock housing defined by an outer housing portion 12 and an inner housing portion 14. A lock cylinder 16 of the key-in-knob type is disposed within the assembled housing portions 12, 14. A driving member 18 is connected to the rear of the lock cylinder 16.

For convenience, the housing portions 12, 14, will be referred to herein as "housings." Also, the use of such terms of position or orientation as "outer," "inner," "front," "rear," "upper," and the like are for purposes of convenience of description only. It is to be understood that the invention and its components can be used in a variety of positions or orientations, and that a variety of words could be used to describe the position or location of the components of the invention relative to each other.

Figure 2:
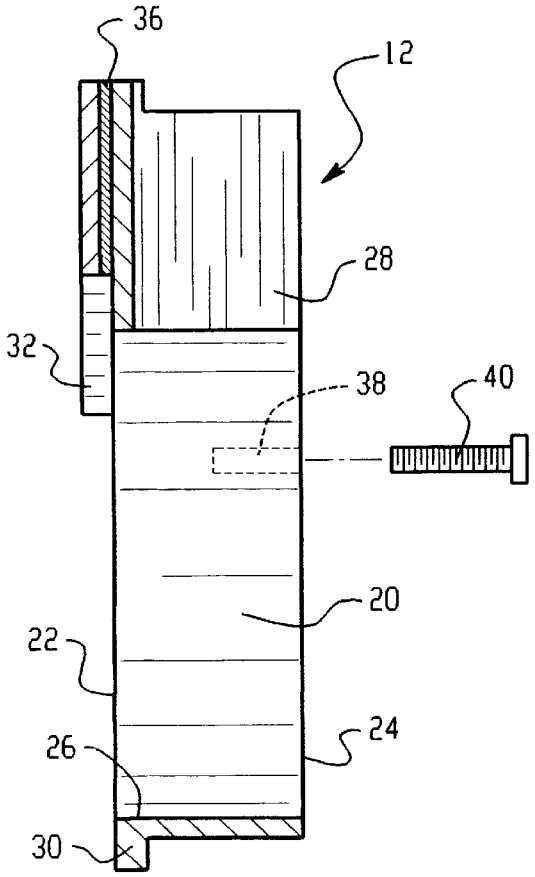
FIG. 2 is a cross-sectional view of an outer housing according to the invention taken along a plane indicated by line 2—2 in FIG. 1.

Referring particularly to FIGS. 1 and 2, the outer housing 12 is in the form of a smoothed-walled cylindrical body portion 20 having a front face 22 and a rear face 24. The body portion 20 includes a longitudinally extending bore 26 that opens through the front and rear faces 22, 24. An elongate, open-ended slot 28 is formed in the upper portion of the body portion 20. The slot 28 opens through the rear face 24 and into the bore 26. A circumferential rim 30 extends about the periphery of the front face 22.

The front face 22 includes an enlarged portion 32 at the upper side thereof. The underside of the enlarged portion 32 is contoured smoothly in order to permit any key that may be used with the lock cylinder 16 to turn freely. If desired, a receptacle 34 can be formed in the center of the enlarged portion 32. A piece of hardened metal in the form of a slug 36 can be placed in the receptacle 34. The rear face 24 includes two small, longitudinally extending, threaded openings 38 adjacent the bore 26 on either side thereof. A pair of small, case-hardened screws 40 can be threaded into the openings 38.

The inner housing 14 is in the form of a threaded cylindrical body portion 42 having a front face 44 and a rear face 46. The body portion 42 includes a longitudinally extending bore 48 that opens through the front at rear faces 44, 46. Referring to FIGS. 7, 8, 10 and 11, the bore 48 includes a reduced-diameter section 50 that defines a shoulder 52. An elongate, open-ended slot 54 is formed in the upper portion of the body portion 42. The slot 54 opens through the front face 44 and into the bore 48. A pair of longitudinally extending threaded openings 56 are disposed adjacent the bore 48 on either side thereof. A shoulder 58 is formed at that end of the openings 56 closest to the front face 44. As shown in FIG. 9, the screws 40 can be fitted into the threaded openings 56 such that the heads of the screws 40 engage the shoulders 58. A pair of longitudinally extending grooves 60 are formed in the outer surface of the body portion 42.

As will be apparent from an examination of FIG. 1, the bores 26, 48 are the same diameter and, in use, are aligned with each other. Similarly, the slots 28, 54 are the same width and height as each other and, in use, are aligned with each other.

The lock cylinder 16 has a cylindrical case 62 within which a cylindrical, rotatable plug 64 is disposed. The plug 64 includes a disk-like front face. A keyway 68 is formed in the front face and the plug 64. A "bible" 70 is secured to the upper side of the case 62 and projects upwardly therefrom. Referring to FIGS. 3, 4, 7 and 8, the rear of the plug 64 includes an extension 72 within which a pair of slots 74, 76 are formed at right angles to each other. A groove 78 extends about the extension 72 and intersects the slots 74, 76. Because the plug 64 is slightly smaller in diameter than the case 62, the case 62 will be retained within the inner housing 14 by the shoulder 52. Also, that portion of the rear face 46 that closes the slot 54 will retain the bible 70, and hence the cylinder 16, within the inner housing 14. In a similar manner, the front face 22 closes the slot 28 and prevents the bible 70, and hence the lock cylinder 16, from being pulled out of the outer housing 12.

In use, the outer and inner housings 12, 14 and the lock cylinder 16 are arranged as shown in FIG. 1 and the housings 12, 14 then are pushed together until the rear 24 and the front face 44 are in surface-to-surface contact. Then, the screws 40 are inserted into the openings 56 and threaded into the openings 38 as shown in FIG. 9. The housings 12, 14 thus are connected securely with the lock cylinder 16 contained therein. As will be apparent from an examination of FIG. 1, the bible 70 completely fills the slots 28, 54 and forms a relatively smooth upper surface for the housings 12, 14.

Figure 5:
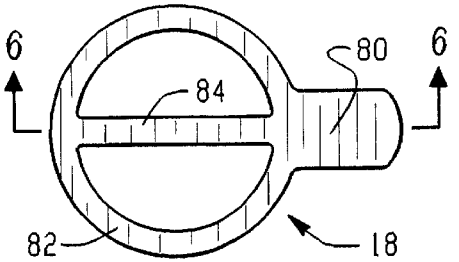
FIG. 5 is a plan view of a cam according to the invention usable as part of a mortise lock.
Figure 6:
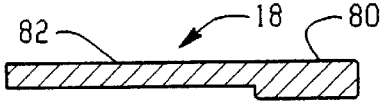
FIG. 6 is a cross-sectional view of the cam of FIG. 5 taken along a plane indicated by line 6—6 in FIG. 5.

The driving member 18 is shown in more detail in FIGS. 5 and 6. The driving member 18 is in the form of a cam having an actuating arm 80, a ring 82, and a crosspiece 84. The ring 84 encircles the extension 72, while the crosspiece 84 fits into a selected slot 74, 76. A retaining ring 86 having a small inwardly projecting portion 88 is fitted into the groove 78 to retain the cam 18 in place. The projecting portion 88 prevents rotation of the retaining ring 86 relative to the extension 72. The components of the invention shown in FIG. 3, when assembled, permit the apparatus 10 to be used as a mortise lock. It is to be understood that driving members 18 having actuating arms of various configurations can be used as part of the invention.

Figure 4:
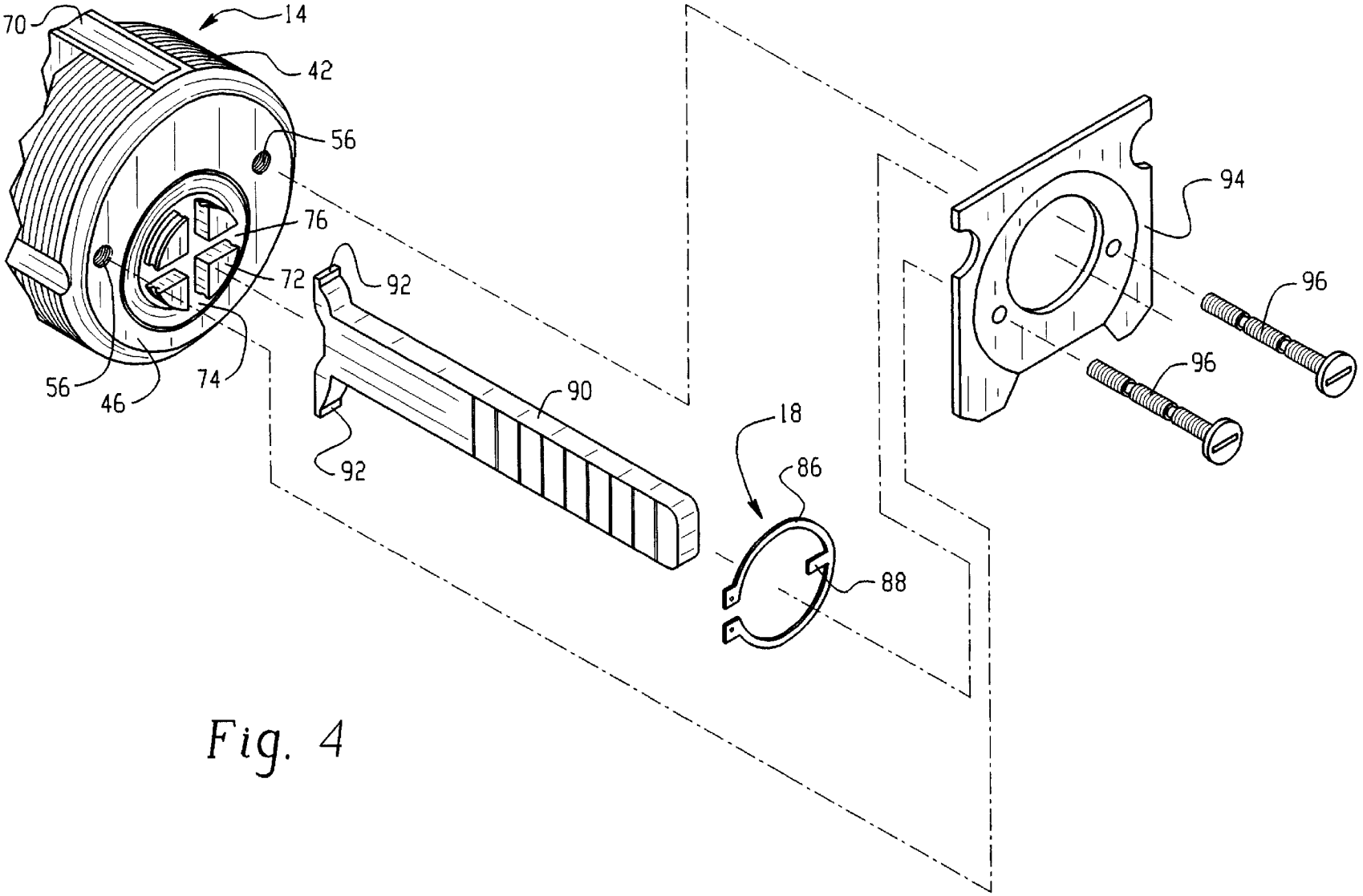
FIG. 4 is a view similar to FIG. 3 showing the invention used as a rim lock.
Figure 8:
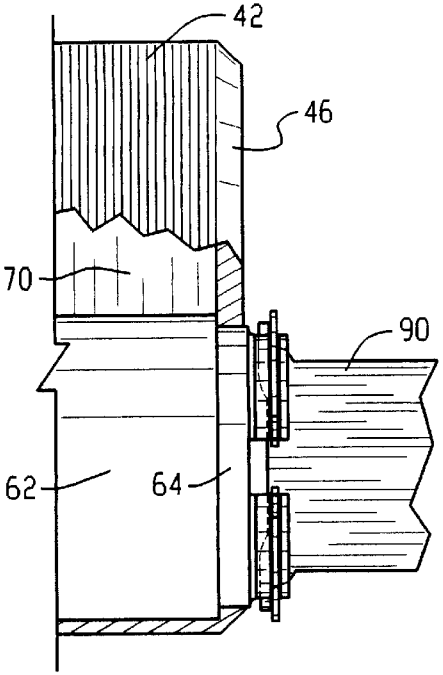
FIGS. 7 and 8 are enlarged side elevational views, partly in section, showing how the components of FIG. 4 are assembled.
Figure 7:
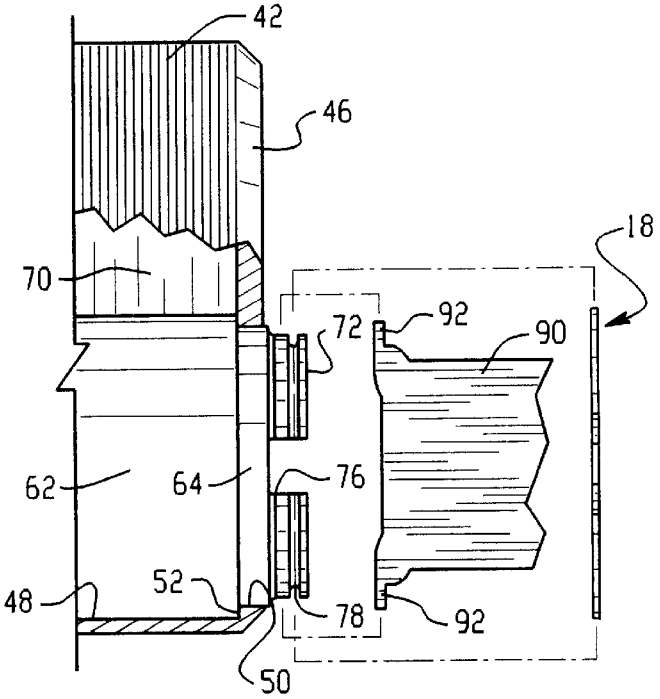
Figure 9:
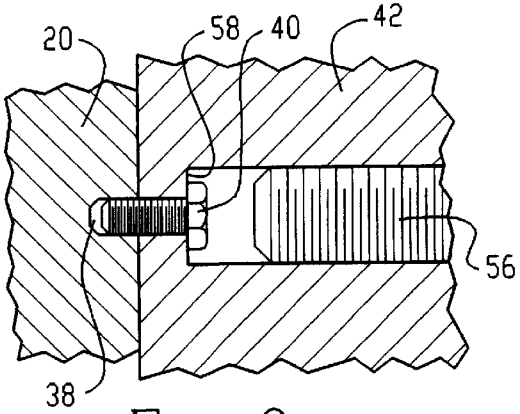
FIG. 9 is a cross-sectional view showing how outer and inner lock housings are connected.

Referring now to FIGS. 4, 7 and 8, components of the invention are shown that enable the apparatus 10 to be used as a rim lock. A tailpiece 90 includes a pair of laterally extending base members, or legs 92. A backing plate 94 of conventional design includes openings through which a pair of conventional rim lock retaining screws 96 extend. As shown in FIGS. 7 and 8, the legs 92 can be fitted within a selected slot 74, 76 and the retaining ring 86 can be fitted into the groove 78 to retain the legs 92 within the selected slot 74 or 76. Thereafter, during installation, the backing plate 94 can be positioned in place on a door and the retaining screws 96 can be fitted into the threaded openings 56 to secure the apparatus 10 in place. Because the screws 40 are at the bottom of the openings 56, they do not interfere with the retaining screws 96.

Figure 10:
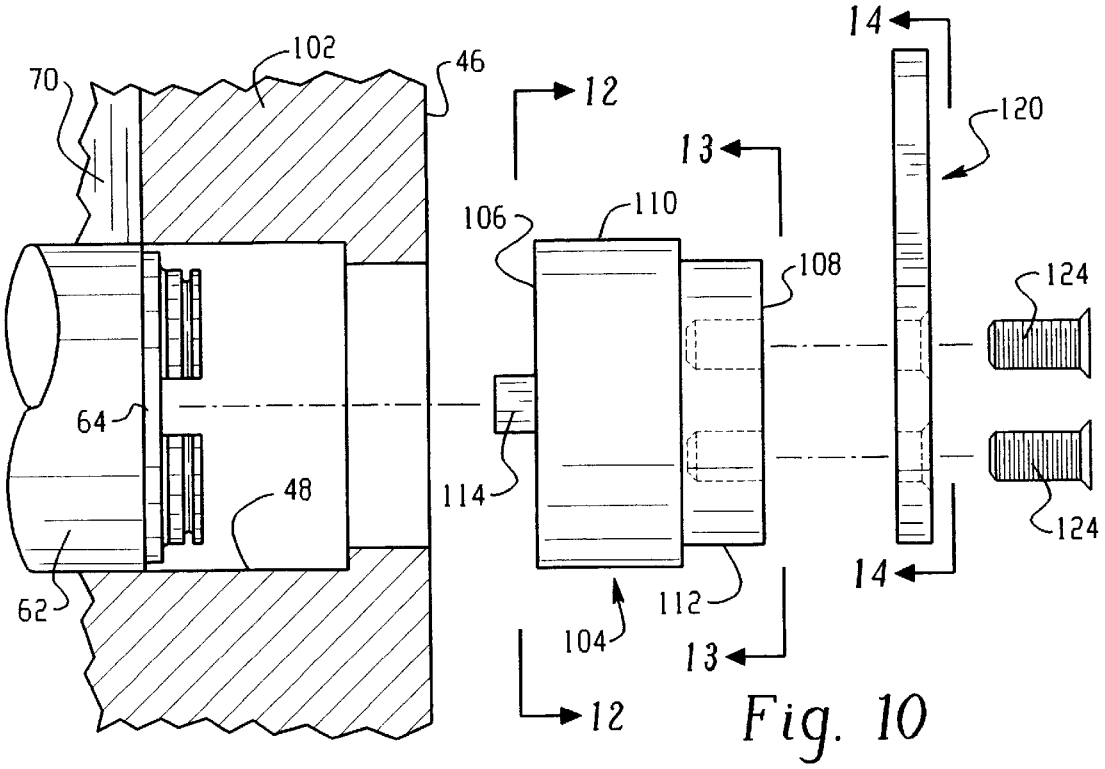
FIG. 10 is an exploded cross-sectional view of an alternative embodiment of the invention showing a cam driver and cam.
Figure 11:
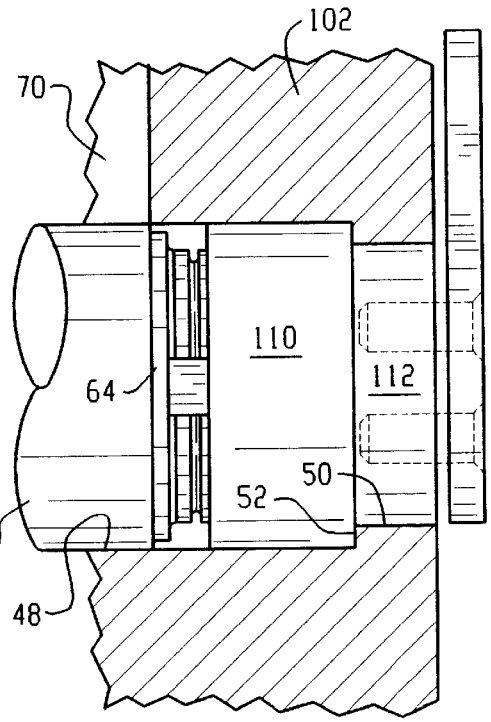
FIG. 11 is a view similar to FIG. 10 showing the parts in an assembled condition.
Figure 12:
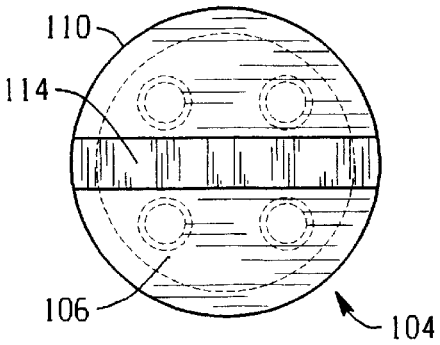
FIGS. 12, 13 and 14 are views taken along planes indicated by lines 12—12, 13—13, and 14—14, respectively, in FIG. 10.
Figure 13:
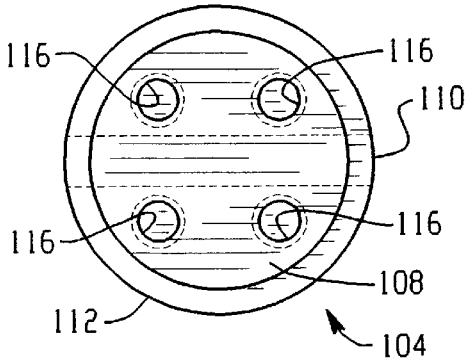
Figure 14:
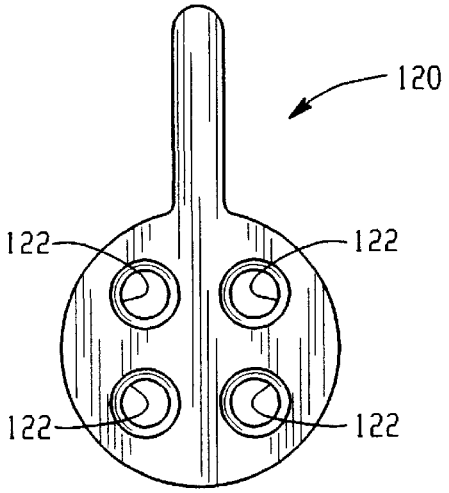

Referring now to FIGS. 10–13, an alternative embodiment of the invention is indicated generally by the reference numeral 100. In the alternative embodiment 100, a plurality of additional inner housings 102 are provided (only one of the additional housings 102 is shown in FIGS. 10 and 11). The inner housings 102 are substantially identical to the inner housing 14 except for the distance between the front face 44 and the rear face 46. A standard mortise cylinder has an overall length of 1⅛ inches. In the context of the present invention, the distance from the front face 22 to the rear face 46, with the outer and inner housings 12, 14 assembled, would be 1⅛ inches. The additional housings 102 are longer than the inner housing 14 to accommodate different applications. Conventional mortise cylinders are provided not only in 1⅛ inch lengths, but also 1¼ inch and 1½ inch lengths. The length of the additional housings 102 is selected to provide an overall outer housing-inner housing length of the foregoing dimensions.

A cam driver 104 is disposed within the bore 48 and the reduced-diameter portion 50 of the additional housing 102. The cam driver 104 is a generally cylindrical member having a front face 106, a rear face 108, a body portion 110, and a reduced-diameter portion 112. A spline 114 projects from the front face 106. A plurality of threaded openings 116 extend into the rear face 108. In use, the rearward-facing surface formed at the intersection of the body portion 110 and the reduced-diameter portion 112 engages the shoulder 52. The spline 114 is fitted into a selected slot 74, 76 so as to establish a driving relationship with the plug 64. The rear face 108 projects beyond the rear face 46 a small distance, approximately 1/16 inch.

Figure 15:
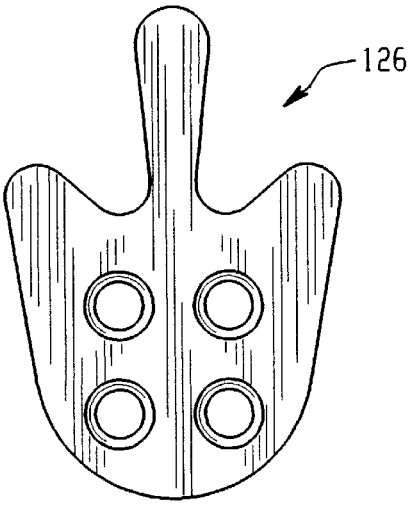
FIGS. 15 and 16 are elevational views of different types of cams usable with the invention.
Figure 16:
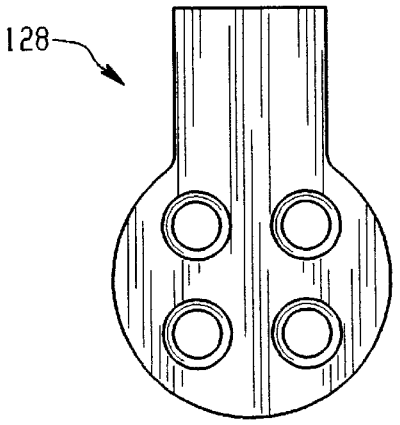

A cam 120 having four openings 122 is connected to the cam driver 104 by means of screws 124 that are threaded through the openings 122 into the openings 116. The cam 120 is of a known construction so as to fit existing lock mechanisms. For example, the cam 120 will fit a Corbin/Russwin mortise deadlock. Additional known cams that can be connected to the cam driver 104 are shown in FIGS. 15 and 16. The cam 126 shown in FIG. 15 is a so-called "cloverleaf" cam, while the cam 128 shown in FIG. 16 is a so-called "standard" cam. It will be understood that a variety of conventional cams are known that can be used with the cam driver 104, all of which can be used successfully if they have openings 122 formed therein.

Operation

As will be appreciated from the foregoing description, the lock cylinder 16 is a conventional key-in-knob cylinder that can be used with any key-in-knob lock. There are about 25 common types of key-in-knob lock cylinders that is, lock cylinders 16 that have differently configured keyways 68. Provided the locksmith has an inventory at least one of each type, he will be able to rekey or replace any key-in-knob lock cylinder.

If the locksmith should encounter a situation where a room lock needs to be rekeyed or replaced, he can take the housings 12, 14 and the lock cylinder 16, and connect the tailpiece 90 to the plug 64 as shown in FIGS. 4, 7, and 8.

Figure 3:
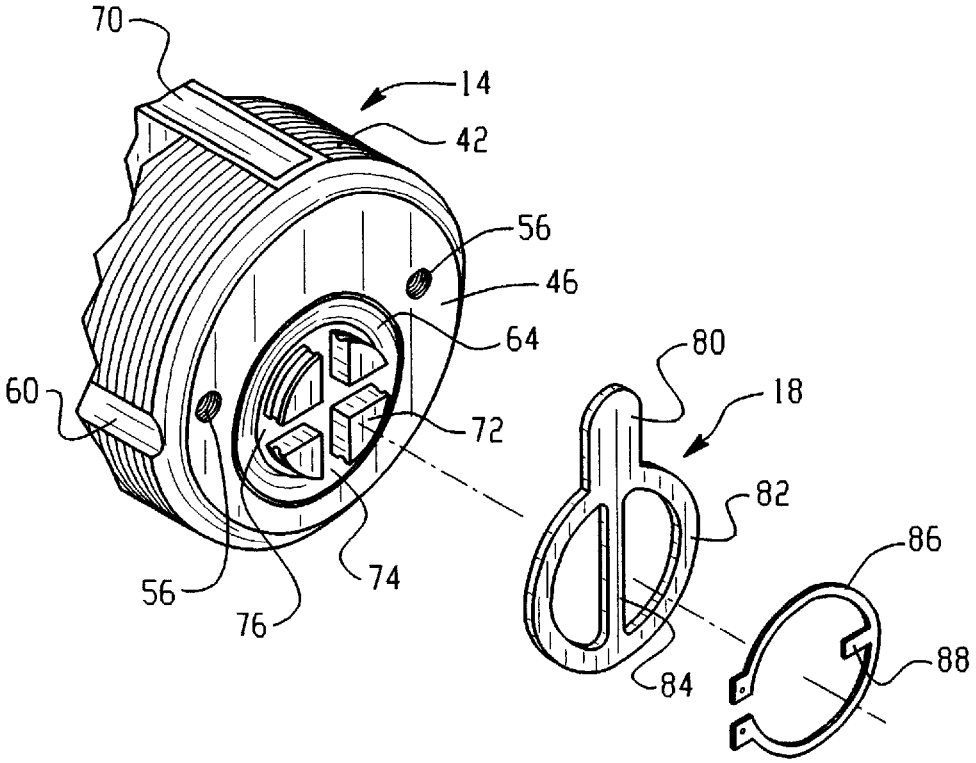
FIG. 3 is an exploded, perspective view of the rear portion of the invention of FIG. 1.

If, on the other hand, the locksmith encounters a mortise lock that needs to be rekeyed or replaced, he can take the components shown in FIGS. 1 and 3 and connect them as described to make a mortise lock. If necessary, mortise locks of different lengths can be created using the additional housings 102 with the corresponding cam driver 104 and cams 120, 126, or 128.

By using the apparatus 10 according to the present invention, the locksmith will need to carry only a minimum of about 25 lock cylinders 16 which, together with only one outer housing 12 and inner housing 14, will enable a total of 75 locks to be rekeyed or replaced, that is, 25 key-in-knob locks, 25 rim cylinder locks, and 25 mortise locks. In those instances where rim locks or mortise locks are replaced by apparatus 10 according to the invention, an exceedingly strong lock is created. The enlarged portion 32 provides greatly enhanced resistance to punching or drilling of the pins contained in the bible 70. If the embodiment employing the receptacle 34 and the slug 36 of hardened metal are used, even greater resistance to punching and drilling will be provided. The case-hardened screws 40 will resist drilling and subsequent separation of the outer and inner housings 12, 14. It will be appreciated that it will be relatively easy and inexpensive to manufacture and assemble the various components of the invention. Accordingly, not only can a locksmith carry an inventory of far fewer lock parts than presently is required, the parts that he must carry in inventory will be relatively inexpensive.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A multi-use lock housing, comprising:

an outer housing having a cylindrical body portion that defines a longitudinal axis, the cylindrical body portion having a front face, a rear face, a longitudinally extending first bore that opens through the front and rear faces, and a rim extending about the periphery of the front face;

a first inner housing having a cylindrical body portion that defines a longitudinal axis, the cylindrical body portion having a front face, a rear face, a longitudinally extending second bore that opens through the front and rear faces, threads on the exterior of the body portion;

the front face of the inner housing adapted in use to engage the rear face of the outer housing with the longitudinal axes of the first and second bores coincident with each other;

means for connecting the outer and inner housings securely together; and each housing further including an open-ended elongate slot opening into its respective bore, the slot in the outer housing opening through the rear face thereof, and the slot in the inner housing opening through the front face thereof.

2. The housing of claim 1, further comprising additional inner housings substantially identical with the first inner housing except having lengths longer than that of the first inner housing, the additional housings being substituted for the first inner housing in applications that require inner housings of longer lengths than the first inner housing.

3. The housing of claim 2, further comprising a cylindrical cam driver disposed in the second bore of a selected additional inner housing and extending through the rear face of the additional inner housing, the cam driver having a spline on one face; and a cam connected to the cam driver.

4. The housing of claim 1, wherein the inner housing further includes a longitudinally extending groove on either side of the body portion on the outer surface thereof.

5. The housing of claim 1, further comprising:

longitudinally extending first threaded openings adjacent the first bore on opposite sides thereof;

longitudinally extending second threaded openings adjacent the second bore on opposite sides thereof, the first and second threaded openings in the inner and outer housings being aligned with each other in use; and the means for connecting being in the form of screws extending between the first and second threaded openings.

6. The housing of claim 5, wherein the second threaded openings are of a size to threadedly receive the screws.

7. The housing of claim 1, wherein the front face of the outer housing includes an enlarged section above the bore.

8. The housing of claim 7, further comprising:

a slot formed in the enlarged section; and an insert of hardened metal disposed in the slot.

9. A multi-use lock housing and cylinder, comprising:

an outer housing having a cylindrical body portion that defines a longitudinal axis, the cylindrical body portion having a front face, a rear face, a longitudinally extending first bore that opens through the front and rear faces, and a rim extending about the periphery of the front face;

a first inner housing having a cylindrical body portion that defines a longitudinal axis, the cylindrical body portion having a front face, a rear face, a longitudinally extending second bore that opens through the front and rear faces, threads on the exterior of the body portion;

the front face of the inner housing adapted in use to engage the rear face of the outer housing with the longitudinal axes of the first and second bores coincident with each other;

means for connecting the outer and inner housings securely together;

each housing further including an open-ended elongate slot opening into its respective bore, the slot in the outer housing opening through the rear face thereof, and the slot in the inner housing opening through the front face thereof; and a lock cylinder of a size and shape to fit within the first and second bores when the outer and inner housings are connected to each other, the lock cylinder having a pin-containing bible that is fitted within the slots of the outer and inner housings, the lock cylinder having a rotatable plug accessible through the opening in the front face of the outer housing, the plug having a keyway into which a properly sized key can be fitted, the plug having a rear face from which an extension projects, the extension including a pair of slots at right angles to each other, the slots adapted to receive a driving member.

10. The housing and cylinder of claim 9, wherein the driving member is selected from the group consisting of a cam and a tailpiece.

11. The housing and cylinder of claim 9, further comprising a circumferential groove extending about the extension and intersecting the slots.

12. The housing and cylinder of claim 11, wherein the driving member includes a portion disposed within one of the slots; and a retaining ring is disposed in the groove to hold the driving member in the slot.

13. The housing and cylinder of claim 12, wherein the retaining ring includes a radially inwardly extending projecting portion that engages the other slot.

14. The housing and cylinder of claim 9, further comprising additional inner housings substantially identical with the first inner housing except having lengths longer than that of the first inner housing, the additional housings being substituted for the first inner housing in applications that require inner housings of longer lengths than the first inner housing.

15. The housing and cylinder of claim 14, further comprising a cylindrical cam driver disposed in the second bore of a selected additional inner housing, the cam driver having a spline on one face and extending through the rear face of the additional inner housing; and a cam connected to the cam driver.

16. The housing and cylinder of claim 9, wherein the inner housing further includes a longitudinally extending groove on either side of the body portion on the outer surface thereof.

17. The housing and cylinder of claim 9, further comprising:

longitudinally extending first threaded openings adjacent the first bore on opposite sides thereof;

longitudinally extending second threaded openings adjacent the second bore on opposite sides thereof, the first and second threaded openings in the inner and outer housings being aligned with each other in use; and the means for connecting being in the form of screws extending between the first and second threaded openings.

18. The housing and cylinder of claim 9, wherein the longitudinally extending threaded openings in the inner housing are of a size to threadedly receive the screws.

19. The housing and cylinder of claim 9, wherein the front face of the outer housing includes an enlarged section above the bore.

20. The housing and cylinder of claim 19, further comprising:

a slot formed in the enlarged section; and an insert of hardened metal disposed in the slot.

* * * * *